US005709420A

United States Patent [19]

Umino

[11] Patent Number: 5,709,420

[45] Date of Patent: Jan. 20, 1998

[54] VEHICLE DOOR LATCH DEVICE

[75] Inventor: Masaaki Umino, Yamanashi-ken, Japan

[73] Assignee: Mitsui Kinzoku Kogyo Kabushiki Kaisha, Tokyo, Japan

[21] Appl. No.: 704,797

[22] Filed: Aug. 26, 1996

[30] Foreign Application Priority Data

Aug. 24, 1995 [JP] Japan ..... 7-237844
Aug. 24, 1995 [JP] Japan ..... 7-237846

[51] Int. Cl.[6] ..... E05C 3/16; E05B 9/00

[52] U.S. Cl. ..... 292/216; 292/337; 292/346; 292/DIG. 23

[58] Field of Search ..... 292/346, 337, 292/216, DIG. 23

[56] References Cited

U.S. PATENT DOCUMENTS

| | | | |
|---|---|---|---|
| 4,538,845 | 9/1985 | Yamada | 292/216 |
| 4,575,138 | 3/1986 | Nakamura et al. | 292/337 X |
| 4,735,447 | 4/1988 | Kleefeldt . | |
| 4,898,414 | 2/1990 | Yamada | 292/337 |
| 4,913,477 | 4/1990 | Watanuki et al. | 292/337 X |
| 4,934,746 | 6/1990 | Yamada . | |
| 4,934,748 | 6/1990 | Hayakawa et al. | 292/337 |
| 4,948,183 | 8/1990 | Yamada | 292/216 X |
| 4,986,098 | 1/1991 | Fisher | 292/216 X |
| 5,000,495 | 3/1991 | Wolfgang et al. | 292/216 |
| 5,072,975 | 12/1991 | Hamada et al. | 292/337 X |
| 5,288,115 | 2/1994 | Inoue et al. | 292/216 X |
| 5,582,444 | 12/1996 | Hayakawa et al. | 292/DIG. 23 X |

FOREIGN PATENT DOCUMENTS

| | | | |
|---|---|---|---|
| 3934982 | 5/1990 | Germany | 292/337 |
| 29023 | 3/1977 | Japan | 292/216 |
| 299980 | 12/1989 | Japan | 292/216 |

*Primary Examiner*—Rodney M. Lindsey
*Attorney, Agent, or Firm*—Browdy and Neimark

[57] ABSTRACT

A vehicle door latch device comprises a synthetic resin latch body which has a recess at a front side thereof for receiving a latch and a ratchet, and a substantially horizontal bulged portion at a rear side thereof for receiving the striker when the door is closed. The latch device further comprises a door opening mechanism for releasing engagement between the latch and the so as to open the door and a locking mechanism displaceable between a locked condition and an unlocked condition. The door opening mechanism and the locking mechanism are located underneath the bulged portion. A protecting plate is attached to the rear side of the latch body for substantially covering the door opening mechanism. The protecting plate has an upper side edge which is adjacent to a lower surface of the bulged portion.

9 Claims, 6 Drawing Sheets

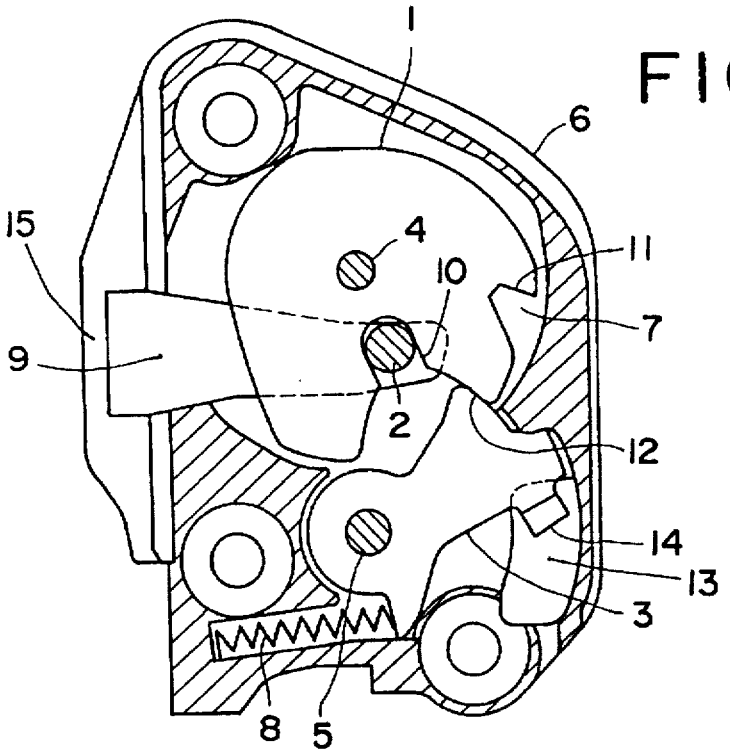
FIG. 1
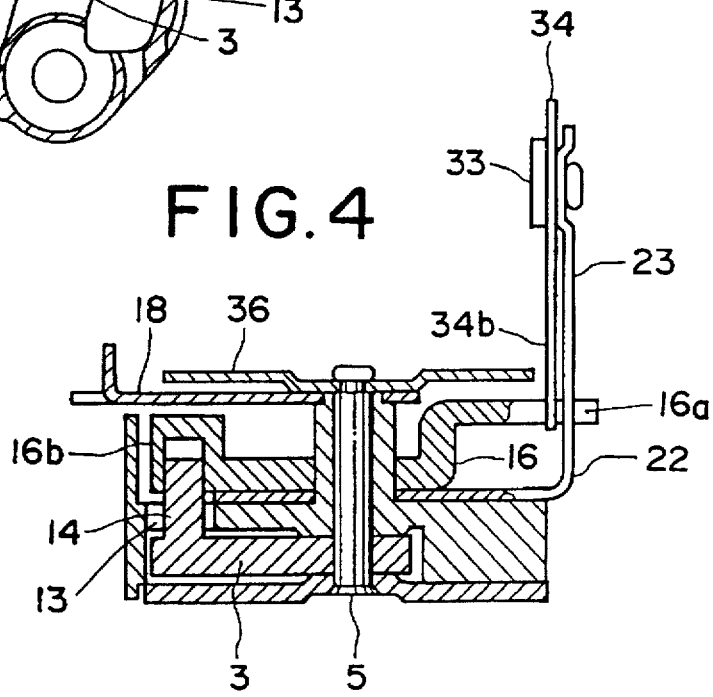
FIG. 4
FIG. 5
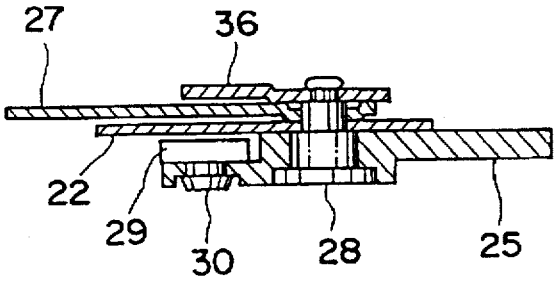

VEHICLE DOOR LATCH DEVICE

BACKGROUND OF THE INVENTION

1. Field of the Invention

The present invention relates to a vehicle door latch device, and in particular, to a door latch device which can hardly be accessed by a thief with a gripping tool such as a slim-jim.

2. Prior Art of the Invention

A conventional door latch device is composed of a locking mechanism which is changed over between a locked condition and an unlocked condition, and a door opening mechanism for opening a door. It is desired that the locking mechanism and the opening mechanism are protected by a protecting plate for preventing them from being accessed by a gripping tool such as a slim jim.

U.S. Pat. No. 4,934,746 discloses a latch device in which a locking mechanism and a door opening mechanism are sandwiched between a latch body of the latch device and a protecting plate mounted on a rear side of the latch body so that it can be difficult to access the mechanisms by a gripping tool. However, this prior art latch device has several disadvantages. The first of these disadvantages is such that the opening mechanism is located above a substantially horizontal bulged portion of the latch body into which a striker enters. With this arrangement, several gaps into which the gripping tool can enter are left between the latch body and the protecting plate. The second disadvantage is such that exposed parts of the opening mechanism which cannot be covered with the protecting plate are defenseless against the access of the gripping tool.

U.S. Pat. No. 4,735,447 discloses a latch device in which a locking mechanism and an opening mechanism are accommodated in a closed latch housing. This conventional latch device is excellent in burglar-proof, but also has such a disadvantage that the housing thereof becomes large. Further, this prior art latch device has several design limitations to the arrangement, the shape, the dimensions and the like of components accommodated in the closed housing, and accordingly, it is not practically usable.

SUMMARY OF THE INVENTION

Accordingly, an object of the present invention is to provide a latch device which can enhance the burglar-proof function without increasing the dimensions of the latch device.

Another object of the present invention is to provide a latch device which can enhance the burglar-proof function without increasing the number of design limitations relating to the arrangements, the shapes, the dimensions and the like of components of a locking mechanism and a door opening mechanism.

BRIEF DESCRIPTION OF THE DRAWINGS

FIG. 1 is a front view of a vehicle door latch device according to the present invention;

FIG. 4 is a sectional view along line IV—IV shown in FIG. 2;

FIG. 5 is a sectional view along line V—V shown in FIG. 2;

DESCRIPTION OF THE PREFERRED EMBODIMENTS

Figure 2:
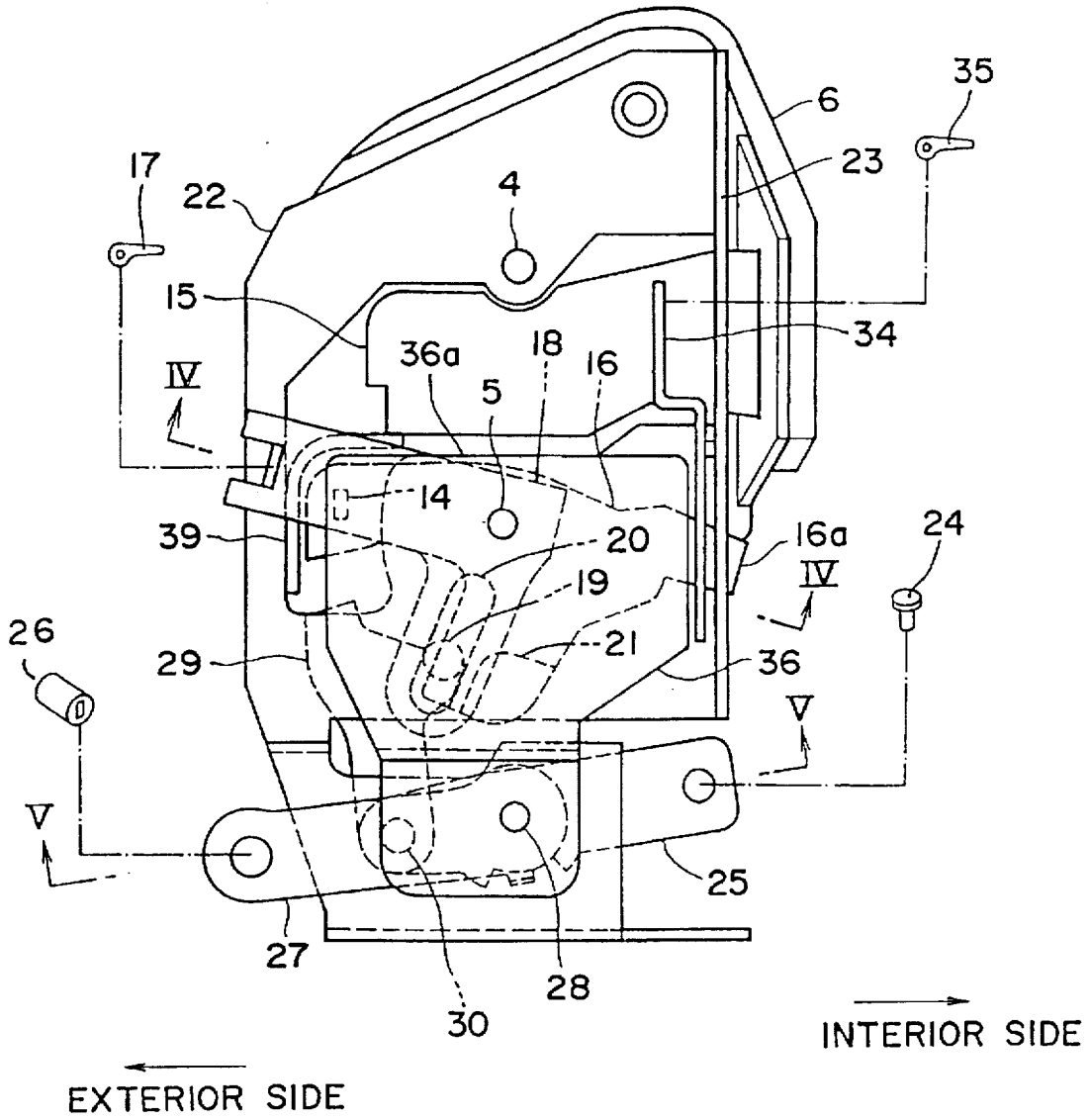
FIG. 2 is a rear view of the door latch device according to the present invention.

Explanation will be made of an embodiment of the present invention with reference to the drawings. A latch device according to the present invention, has a latch 1 adapted to be engaged with a striker 2 secured to a vehicle body, and a ratchet for holding the engagement between the latch 1 and the striker 2. The latch 1 and the ratchet 3 are rotatably received in a recess 7 formed in the latch body 6 made of synthetic resin, by means of a latch shaft 4 and a ratchet shaft 5, respectively. The latch 1 is urged by the resilient force of a spring (not shown), clockwise as viewed in FIG. 1, and the ratchet 3 is urged counterclockwise by the resilient force of a spring 8. The latch device is secured to a vehicle door.

When the door is closed, the striker 2 enters a horizontal passage 9 formed in the latch body 6, and engages with a fork part 10 of the latch 1. When the latch 1 is turned counterclockwise to a half-latch position through the engagement with the striker 2, the ratchet 3 is engaged with a first step part 11 of the latch 1, and when the latch 1 comes to a full-latch position, the ratchet 3 is engaged with a second step 12 of the latch 1.

The ratchet 3 has a protrusion 14 which projects toward a rear side of the latch body 6 through an opening 13 formed in the latch body 6. When the protrusion 14 is moved downward by a door opening mechanism which will be described hereinbelow, the ratchet 3 is disengaged from the latch 1 so as to open the door.

FIG. 2 shows a door opening mechanism and a locking mechanism provided on the rear side of the latch body 6. The latch body 6 has on its rear side a substantially horizontal bulged portion 15 which is rearward bulged so as to define the passage 9. The door opening mechanism and the locking mechanism are arranged below the bulged portion 15. Since the upper side of both opening and locking mechanisms is covered with the bulged portion 15 such as a pent-roof, the mechanisms can hardly be accessed by a thief with the use of a gripping tool such as a slim-jim which is inserted into the gap between the lower edge of a closed window above the latch device and the adjacent edge of the corresponding vehicle door panel.

Figure 6:
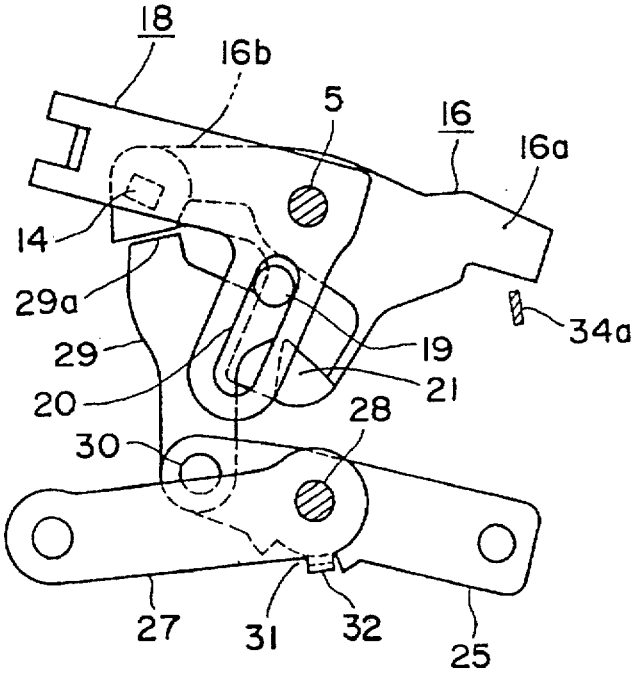
FIG. 6 is a segmentary view of a door opening mechanism and a locking mechanism in a locked condition.
Figure 7:
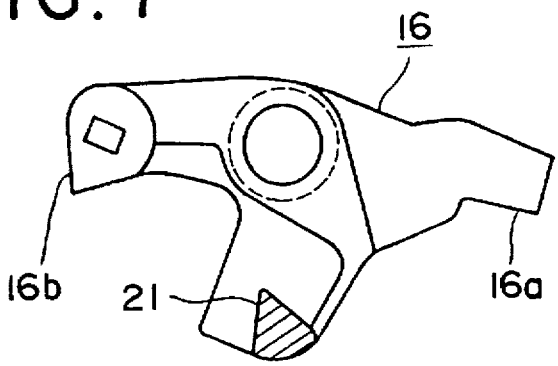
FIG. 7 is a plan view of a ratchet lever.
Figure 8:
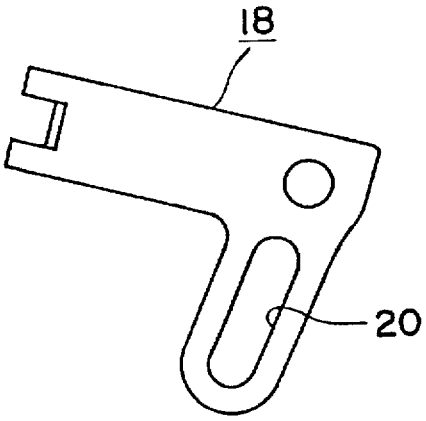
FIG. 8 is a plan view of an opening lever.
Figure 11:
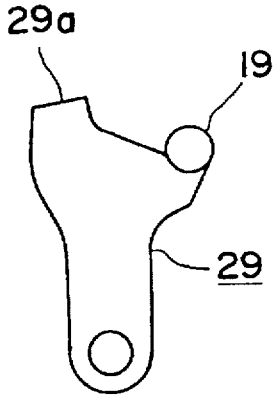
FIG. 11 is a plan view of a link.

The door opening mechanism has a ratchet lever 16 (FIG. 7) coupled to the protrusion 14 of the ratchet 3, and an opening lever 18 (FIG. 8) coupled to an outer door opening handle 17. The levers 16 and 18 are rotatably supported to the ratchet shaft 5, as shown in FIG. 4. The opening lever 18 is formed therein with an elongated hole 20 in which a pin 19 of the locking mechanism is slidably engaged. The pin 19 is opposed to a protrusion 21 formed on the ratchet lever 16 when the locking mechanism is in an unlocked condition as shown in FIG. 2. Therefore, in the unlocked condition, the opening manipulation of the opening handle 17 causes the pin 19 to push the protrusion 21, to thereby rotate the ratchet lever 16 and the ratchet 3 so as to open the door. Oppositely, when the locking mechanism is in a locked condition as shown in FIG. 6, the pin 19 is separated from the protrusion 21, therefore, the pin 19 can not push the protrusion 21 even though the door opening handle 17 is manipulated for opening the door.

Figure 12:
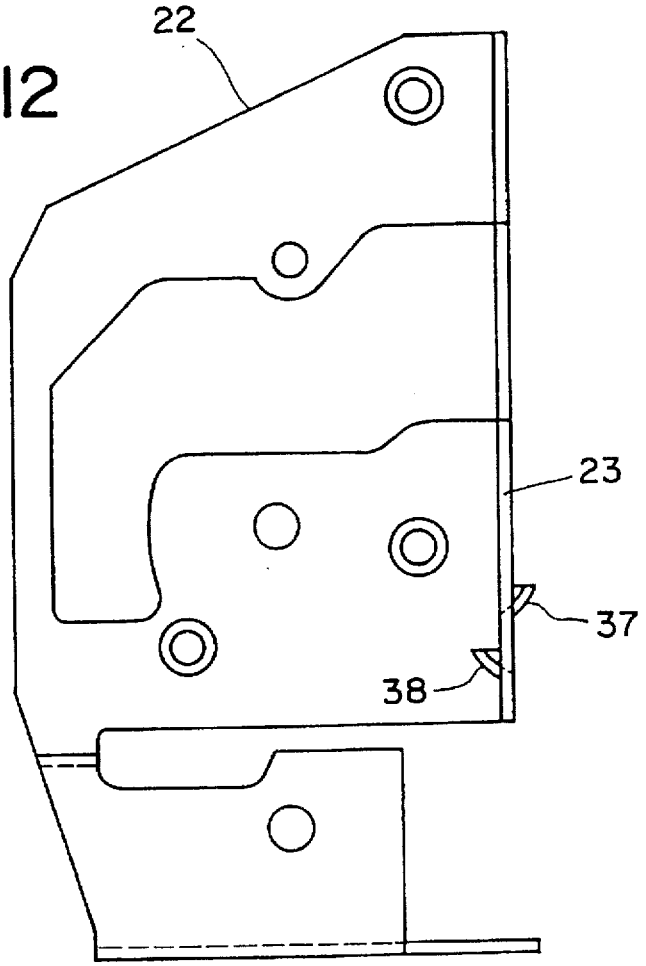
FIG. 12 is a plan view of a back plate.
Figure 13:
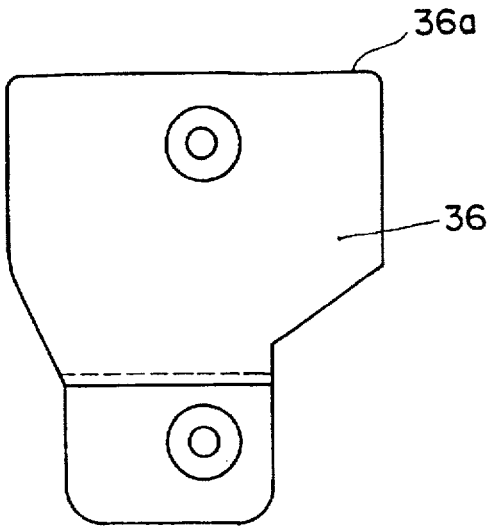
FIG. 13 is a plan view of a protecting plate.

A metallic back plate 22 as shown in FIG. 12 is secured to the rear side of the latch body 6. An angled plated 23 which projects rearward is integrally formed with the interior side of the back plate 22.

Figure 9:
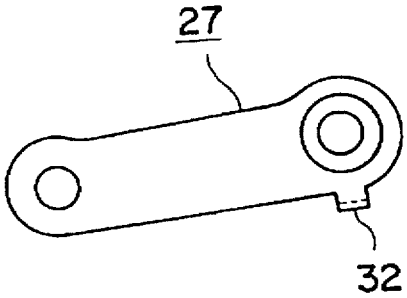
FIG. 9 is a plan view of a key lever.
Figure 10:
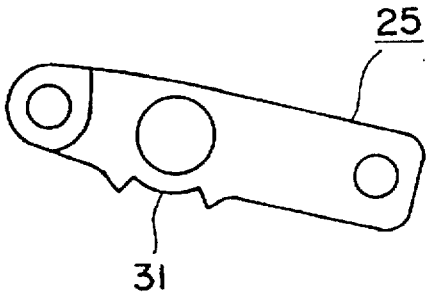
FIG. 10 is a plan view of a lock lever.

The locking mechanism has a locking lever 25 (FIG. 10) coupled to an inside locking button 24, and a key lever 27 (FIG. 9) coupled to a door key cylinder 26. The locking lever 25 and the key lever 27 are rotatably supported to the back plate 22 by a shaft 28 as shown in FIG. 5. A link 29 is connected at its one end to the locking lever 25 by a pin 30, and is integrally provided at the other end with the pin 19. As shown in FIG. 10, a cut-out part 31 is formed in the locking lever 25, and a bent part 32 of the key lever 27 is engaged with the cut-out part 31 with a lost-motion.

The key lever 27 is connected with the key cylinder 26 without a lost-motion and is usually held in a neutral position as shown in FIG. 2. The key lever 27 is turned clockwise due to a locking rotation of the key cylinder 26, and is turned counterclockwise due to an unlocking rotation of the key cylinder 26. In the unlocked condition shown in FIG. 2, when the key lever 27 is turned clockwise, the bent part 32 abuts against the cut-out part 31 so as to turn the lock lever 25 clockwise, and then, the link 29 is moved upward so that the pin 19 is disengaged from the protrusion 21 on the ratchet lever 16. As a result, the locking mechanism falls in the locked condition.

An inner lever 34 is journalled to the angled plate 23 of the back plate 22 by a shaft 33. The inner lever 34 is coupled to an inner open handle 35 of the door. One end 34*a* of the inner lever 34 is opposed to a right arm 16*a* of the ratchet lever 16. When the inner lever 34 is turned through the opening manipulation of the inner open handle 35, the one end 34*a* is engaged with the right arm 16*a* so as to turn the ratchet lever 16 counterclockwise as viewed in FIG. 2, and then, the door is opened. Thus, the door opening manipulation of the inner open handle 35 is directly transmitted to the ratchet lever 16. This arrangement is called one-motion door opening mechanism.

In the locked condition shown in FIG. 6, a cancelling surface 29*a* of the link 29 is located in the vicinity of a left arm 16*b* of the ratchet lever 16. When, in the locked condition, the ratchet lever 16 is turned counterclockwise by the one-motion door opening mechanism, the left arm 16*b* of the ratchet lever 16 is engaged with the cancelling surface 29*a* of the link 29 so as to move the link 29 downward, and then, the locking lever 25 is displaced into the unlocked position.

The door opening mechanism and the locking mechanism is substantially covered with a protecting plate 36 for preventing them from being accessed by a thief with the use of the gripping tool. The protecting plate 36 is secured to each one end of the shaft 5 and the shaft 28. An upper side edge 36*a* of the protecting plate 36 is substantially horizontal, and is adjacent to the lower or bottom surface of the horizontal bulged portion 15. As the protecting plate 36 has dimensions with which it can cover the latch body 6 underneath the bulged portion 15, it is lightweight.

Figure 14:
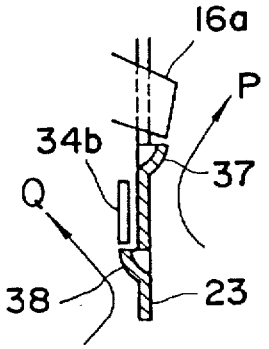
FIG. 14 is a sectional view illustrating a protecting protrusion and an elongated projection formed on an angled plate of the back plate.
Figure 15:
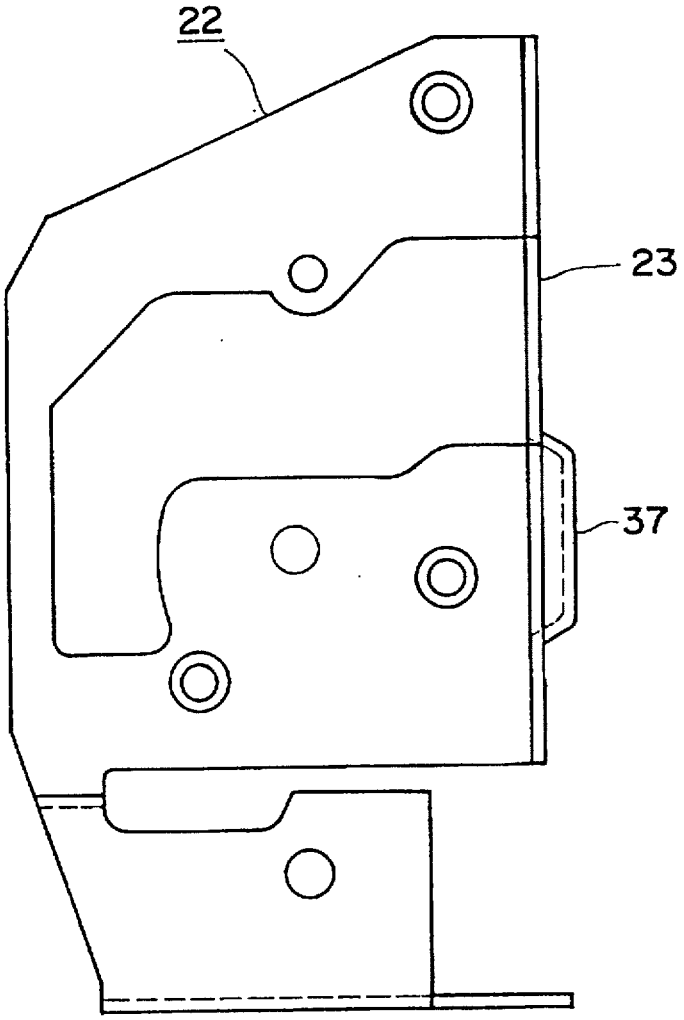
FIG. 15 is a plan view of another back plate of the present invention.
Figure 16:
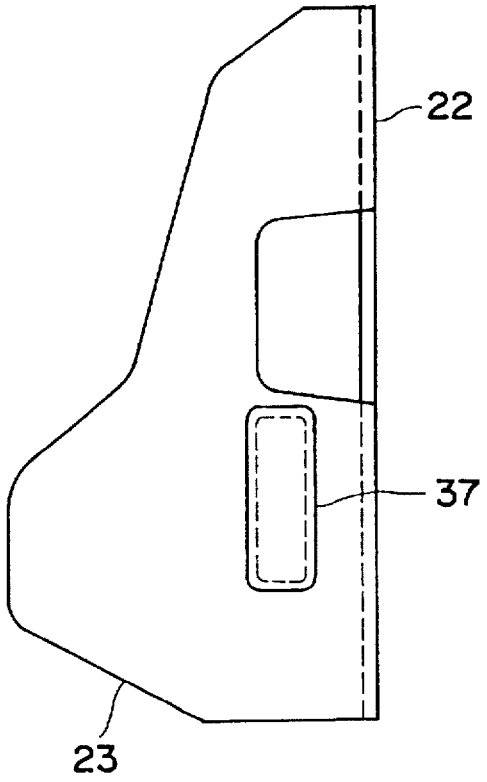
FIG. 16 is a side view of the back plate of FIG. 15.

The latch device according to the present invention further has some additional antitheft members for effectively preventing the latch device from being accessed by the gripping tool. The first antitheft member is a protrusion 37 which is provided on the angle plate 23 of the back plate 22 for protecting the right arm 16*a* of the ratchet lever 16. The protrusion 37 is located below the tip end of the right arm 16*a* so as to prevent access by the gripping tool as indicated by the arrow P shown in FIG. 14. It is noted that the protrusion 37 may be formed on the ratchet body 6, instead of the back plate 22. FIGS. 15 and 16 show another type of the protrusion 37 which can completely cover the tip end of the right arm 16*a*.

Figure 3:
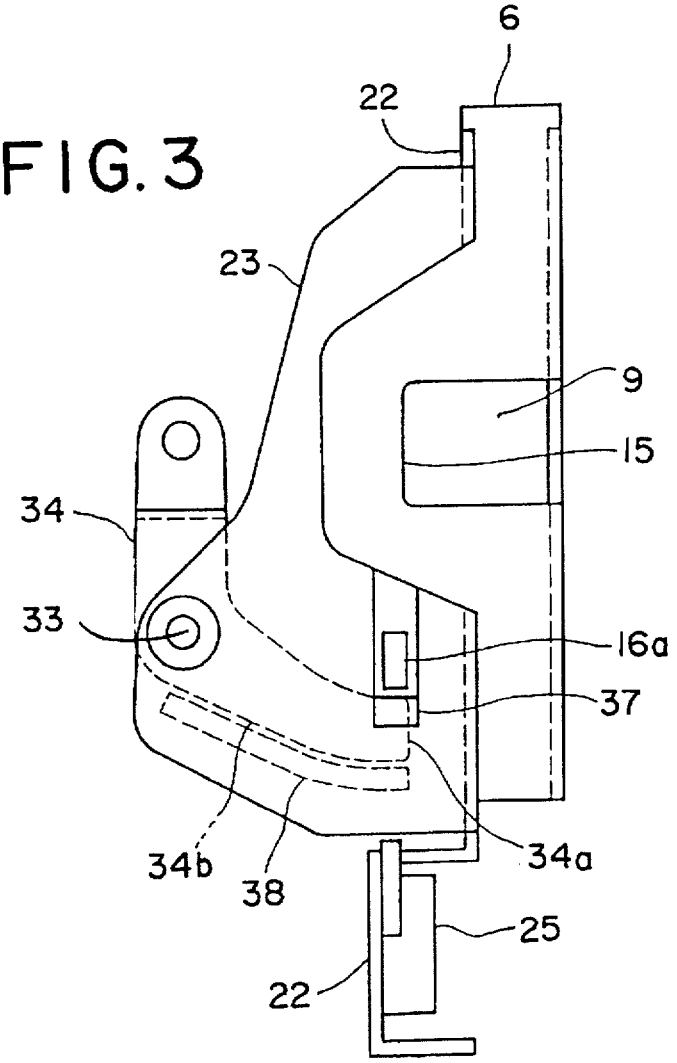
FIG. 3 is a side view of the door latch device according to the present invention.

The second antitheft member is an elongated projection 38 such as a rib which is formed on the angled plate 23 of the back plate 22 for protecting the inner lever 34. As shown in FIGS. 3 and 14, the projection 38 is located underneath a horizontal arm 34*b* of the inner lever 34 so as to prevent access by the gripping tool indicated by the arrow Q.

The third antitheft member is a protecting wall 39 which hides a gap between the latch body 6 and the upper side edge 36*a* of the protecting plate 36. The wall 39 is integrally formed with the latch body 6, and is extended from the left end of the bulged part 15 toward the exterior side of the latch device. The exterior side of the wall 39 is preferably downwardly curved.

The first to third antitheft members can be simply and inexpensively added in conventional latch devices. In almost every case, it is not necessary to newly design the door opening mechanism and the locking mechanism in order to attach the protecting plate and the first to third antitheft members in the latch device. Further, the protecting plate and the first to third antitheft members do not cause the latch device to have large dimensions.

What is claimed is:

1. A vehicle door latch device for use on a vehicle door comprising:

a synthetic resin latch body for being mounted on the vehicle door and having a recess at a front side thereof;

a latch rotatably accommodated in the recess and engageable with a striker secured to a vehicle body when the vehicle door is closed;

a ratchet rotatably accommodated in the recess for holding engagement between the latch and the striker;

said latch body having a substantially horizontal bulged portion at a rear side thereof which is rearward bulged to define a passage for receiving the striker when the door is closed;

a door opening mechanism provided on the rear side of the latch body for releasing the engagement between the latch and the striker so as to open the door;

a locking mechanism provided on the rear side of the latch body and displaceable between a locked condition for disabling an opening operation of the door opening mechanism and an unlocked condition for enabling the opening operation of the door opening mechanism;

said door opening mechanism and said locking mechanism being located below the bulged portion when the door latch device is in use on the door in a manner to divert an intruding tool away from said door opening mechanism;

a metallic plate attached to an interior side of the rear side of the latch body, said metallic plate having an angled plate projecting rearwardly;

an inner lever journalled to the angled plate by a supporting shaft for operating the door opening mechanism, said inner lever being coupled to an inner open handle for the vehicle door; and a protecting plate attached to the rear side of the latch body for substantially covering the door opening mechanism, said protecting plate attached to said latch body at a lower end of the protecting plate and at a position on the latch body spaced from a lower surface of the bulged portion, the door opening mechanism being located between said position and said lower surface, and said protecting plate extending from said position over the door opening mechanism and ending at an upper side edge which is adjacent and proximate said lower surface of the bulged portion, said protecting plate extending to and ending at an interior side edge which does not reach the angled plate the upper side edge and interior side edge lying in a plane.

2. A latch device according to claim 1, wherein said door opening mechanism has a ratchet lever coupled with the ratchet, said ratchet lever has a first arm extending toward an interior side of the latch body, said first arm is engaged with the inner lever to move upward when the inner lever rotates, and wherein said angled plate has first antitheft means for covering at least a lower tip end of the first arm to obstruct direct manipulation of the lower tip end by means of an intruding tool.

3. A latch device according to claim 1, wherein said door opening mechanism has a ratchet lever coupled with the ratchet, said ratchet lever having a first arm extending toward the interior side of the latch body, said inner lever has a substantially horizontal second arm, when not operated, which is engageable with the first arm, and wherein said metallic plate has second antitheft means which extends substantially parallel with the second arm for covering a lower surface of the second arm to obstruct direct manipulation of the second arm by means of an intruding tool.

4. A latch device according to claim 1, wherein said latch body has third antitheft means integrally formed therewith which extends from the bulged portion toward an exterior side of the latch body for substantially hiding a gap between the upper side edge of the protecting plate and the latch body.

5. A latch device according to claim 4, wherein an exterior side of said third antitheft means is curved downward.

6. A latch device according to claim 2, wherein said first antitheft means has a portion which is for projecting toward the interior side of the latch body.

7. A latch device according to claim 3, wherein said second antitheft means has a portion which is integrally formed with the metallic plate and is for projecting parallel with an axis of the supporting shaft.

8. A vehicle door latch device for use on a vehicle door comprising:

a synthetic resin latch body for being mounted on the vehicle door and having a recess at a front side thereof;

a latch rotatably accommodated in the recess and engageable with a striker secured to a vehicle body when the vehicle door is closed;

a ratchet rotatably accommodated in the recess for holding engagement between the latch and the striker;

a door opening mechanism provided on a rear side of the latch body for releasing the engagement between the latch and the striker so as to open the door;

a locking mechanism provided on the rear side of the latch body and displaceable between a locked condition for disabling an opening operation of the door opening mechanism and an unlocked condition for enabling the opening operation of the door opening mechanism;

a metallic plate attached to an interior side of the rear side of the latch body, said metallic plate having an angled plate projecting rearwardly;

an inner lever journalled to the angled plate by a supporting shaft for operating the door opening mechanism, said inner lever being coupled to an inner open handle for the vehicle door;

said door opening mechanism having a ratchet lever coupled with the ratchet;

said ratchet lever having a first arm extending toward an interior side of the latch body;

said first arm being engaged with the inner lever to move upward when the inner lever rotates; and said angled plate having an antitheft portion formed in one piece therewith and projecting toward the interior side of the latch body for covering at least a lower tip end of the first arm to obstruct direct manipulation of the lower tip end by means of an intruding tool.

9. A vehicle door latch device for use on a vehicle door comprising:

a synthetic resin latch body for being mounted on the vehicle door and having a recess at a front side thereof;

a latch rotatably accommodated in the recess and engageable with a striker secured to a vehicle body when the vehicle door is closed;

a ratchet rotatably accommodated in the recess for holding engagement between the latch and the striker;

a door opening mechanism provided on a rear side of the latch body for releasing the engagement between the latch and the striker so as to open the door;

a locking mechanism provided on the rear side of the latch body and displaceable between a locked condition for disabling an opening operation of the door opening mechanism an unlocked condition for enabling the opening operation of the door opening mechanism;

a metallic plate attached to an interior side of the rear side of the latch body, said metallic plate having an angled plate projecting rearwardly;

an inner lever journalled to the angled plate by a supporting shaft for operating the door opening mechanism, said inner lever coupled to an inner open handle for the vehicle door;

said door opening mechanism having a ratchet lever coupled with the ratchet;

said ratchet lever having a first arm extending toward an interior side of the latch body;

said inner lever having a substantially horizontal second arm when not operated, which is engageable with the first arm; and said angled metallic plate having an elongated antitheft portion formed in one piece therewith which is bulged in a direction parallel with an axis of the supporting shaft and extends substantially parallel with the second arm and covers a lower surface of the second arm to obstruct direct manipulation of the second arm by means of an intruding tool.

* * * * *